US012558611B2

(12) United States Patent
Weig

(10) Patent No.: US 12,558,611 B2
(45) **Date of Patent: *Feb. 24, 2026**

(54) SYSTEM FOR STORAGE OF PUZZLE PIECES, SALES UNIT OF A PUZZLE AND A METHOD FOR MANUFACTURING A PUZZLE

(71) Applicant: puzzleYOU GmbH, Altenstadt a.d. Waldnaab (DE)

(72) Inventor: Norbert Weig, Parkstein (DE)

(73) Assignee: PUZZLEYOU GMBH, Altenstadt a.d. Waldnaab (DE)

( * ) Notice: Subject to any disclaimer, the term of this patent is extended or adjusted under 35 U.S.C. 154(b) by 0 days.

This patent is subject to a terminal disclaimer.

(21) Appl. No.: 18/562,602

(22) PCT Filed: May 20, 2022

(86) PCT No.: PCT/EP2022/063790
§ 371 (c)(1),
(2) Date: Nov. 20, 2023

(87) PCT Pub. No.: WO2022/243542
PCT Pub. Date: Nov. 24, 2022

(65) Prior Publication Data

US 2024/0226712 A1 Jul. 11, 2024

(30) Foreign Application Priority Data

May 21, 2021 (DE) ..... 10 2021 113 338.6

(51) Int. Cl.
*A63F 9/10* (2006.01)
*B65D 25/10* (2006.01)
*B65D 77/04* (2006.01)

(52) U.S. Cl.
CPC ..... *A63F 9/1044* (2013.01); *B65D 25/108* (2013.01); *B65D 77/0413* (2013.01); *A63F 2009/1072* (2013.01); *B65D 2577/043* (2013.01)

(58) Field of Classification Search
CPC ..... A63F 9/1044; A63F 2009/1072; B65D 25/108; B65D 77/0413; B65D 2577/043
(Continued)

(56) References Cited

U.S. PATENT DOCUMENTS 723,425 A 3/1903 Thompson
1,957,078 A 5/1934 Robillard
(Continued)

FOREIGN PATENT DOCUMENTS

CN 201361741 12/2009
CN 111939554 A 11/2020
(Continued)

OTHER PUBLICATIONS

International Search Report, with English translation, issued in corresponding International Application No. PCT/EP2022/063790, date of mailing Oct. 7, 2022 (5 pages).
(Continued)

*Primary Examiner* — Jacob K Ackun
(74) *Attorney, Agent, or Firm* — Abel Schillinger, LLP

(57) ABSTRACT

A sales unit of a puzzle with a puzzle which comprises a plurality of puzzle pieces which together form a picture with one or more motifs, as well as a storage container for the puzzle pieces, wherein the puzzle pieces of one picture are assembled into at least two or more groups with two or more puzzle pieces respectively, irrespective of the motif or motifs, wherein the groups of puzzle pieces are arranged separately from one another in the storage container. A method for manufacturing the puzzle as well as a system for
(Continued)

storage of a puzzle with a storage container and two or more dimensionally stable sub-storage containers can include each sub-storage container receiving a group of puzzle pieces with two or more puzzle pieces.

19 Claims, 9 Drawing Sheets

(58) Field of Classification Search
USPC ..... 206/579
See application file for complete search history.

(56) References Cited

U.S. PATENT DOCUMENTS

| | | | | |
|---|---|---|---|---|
| 1,987,496 | A | 1/1935 | Springborn | |
| 2,089,225 | A | 8/1937 | Polachek | |
| 2,731,766 | A | 1/1956 | Rubin | |
| 3,191,937 | A | 6/1965 | Kropinski | |
| 3,851,884 | A | 12/1974 | Myller | |
| 3,879,861 | A | 4/1975 | Grantham | |
| 4,258,920 | A | 3/1981 | Waldron et al. | |
| 4,385,467 | A | 5/1983 | Samuels | |
| 4,436,307 | A * | 3/1984 | Caldwell | A63F 9/1044 273/157 R |
| 4,487,585 | A | 12/1984 | Goldwasser | |
| 4,552,361 | A | 11/1985 | LaFleur | |
| 4,709,928 | A | 12/1987 | Willingham | |
| 4,811,951 | A | 3/1989 | Dorsey-Zinn et al. | |
| 4,822,051 | A | 4/1989 | Nowak et al. | |
| 4,865,325 | A | 9/1989 | Stolz | |
| 4,986,756 | A | 1/1991 | Yamaguchi | |
| 4,995,813 | A | 2/1991 | Francioni | |
| 5,062,637 | A | 11/1991 | Bianchi | |
| 5,123,846 | A | 6/1992 | Lewis | |
| 5,203,571 | A | 4/1993 | Fischer | |
| 5,249,802 | A | 10/1993 | McCarthy | |
| 5,332,220 | A | 7/1994 | Leavy | |
| 5,360,215 | A | 11/1994 | Ruben | |
| 5,362,054 | A | 11/1994 | Ashemimry | |
| 5,375,707 | A | 12/1994 | Richer | |
| 5,443,263 | A | 8/1995 | Olmsted et al. | |
| 5,624,118 | A | 4/1997 | Gottesman | |
| 5,735,442 | A | 4/1998 | Emrich | |
| 5,865,928 | A | 2/1999 | Lariviere, Jr. et al. | |
| 5,868,389 | A | 2/1999 | Kalivas | |
| 5,979,895 | A | 11/1999 | Dove | |
| 6,141,851 | A | 11/2000 | Reinbold, Jr. | |
| 6,364,116 | B1 * | 4/2002 | Ng | A63F 9/1044 273/157 R |
| 6,474,641 | B1 | 11/2002 | Kellock | |
| 6,830,150 | B1 | 12/2004 | Cyr | |
| 7,631,870 | B1 | 12/2009 | Bennett | |
| 7,815,190 | B1 | 10/2010 | Krisch et al. | |
| 8,235,207 | B2 | 8/2012 | Dietenberger | |
| 9,168,453 | B2 | 10/2015 | Handstein | |
| 9,308,438 | B2 | 4/2016 | Yoshida | |
| 9,403,084 | B2 | 8/2016 | Klemm | |
| 2002/0093137 | A1 | 7/2002 | Enko | |
| 2002/0163126 | A1 | 11/2002 | Caldwell | |
| 2004/0050225 | A1 | 3/2004 | Steiner | |
| 2004/0228989 | A1 | 11/2004 | Abramek | |
| 2005/0167913 | A1 | 8/2005 | Mucci et al. | |
| 2005/0200076 | A1 | 9/2005 | Wu | |
| 2005/0236287 | A1 * | 10/2005 | Bretones | A63F 9/1044 206/315.1 |
| 2007/0152400 | A1 | 7/2007 | Cooper | |
| 2008/0044511 | A1 | 2/2008 | Chang et al. | |
| 2012/0024729 | A1 * | 2/2012 | Dietenberger | A63F 9/10 206/315.1 |
| 2013/0234390 | A1 | 9/2013 | Pabon | |
| 2014/0014540 | A1 * | 1/2014 | Weldring | A63F 9/1044 206/315.1 |
| 2019/0118074 | A1 | 4/2019 | Heringer | |
| 2021/0146234 | A1 | 5/2021 | Wheeler et al. | |
| 2021/0170267 | A1 | 6/2021 | Malki | |
| 2022/0047938 | A1 | 2/2022 | Miller | |
| 2022/0370891 | A1 | 11/2022 | Weig | |
| 2022/0395997 | A1 | 12/2022 | Weig | |
| 2022/0409989 | A1 | 12/2022 | Weig | |

FOREIGN PATENT DOCUMENTS

| | | | |
|---|---|---|---|
| DE | 690380 | | 4/1940 |
| DE | 1044579 | | 11/1958 |
| DE | 132107 | | 8/1978 |
| DE | 8900811.1 | U1 | 5/1989 |
| DE | 69206090 | T2 | 4/1996 |
| DE | 20205099 | U1 | 9/2002 |
| DE | 102010021279 | A1 | 11/2011 |
| DE | 10 2016 009 069 | A1 | 2/2017 |
| DE | 102017124500 | B3 | 12/2018 |
| EP | 0518223 | A1 | 12/1992 |
| EP | 0697940 | B1 | 2/1996 |
| EP | 2 184 141 | A1 | 5/2010 |
| ES | 2 485 313 | T3 | 8/2014 |
| FR | 1501915 | | 11/1967 |
| FR | 2223956 | | 10/1974 |
| FR | 2758529 | A1 | 7/1998 |
| GB | 2254565 | A | 10/1992 |
| JP | 7-241888 | A | 9/1995 |
| JP | 2009-28493 | | 2/2009 |
| JP | 2009-136621 | | 6/2009 |
| JP | 5836426 | B2 | 11/2015 |
| JP | 2017-42180 | A | 3/2017 |
| KR | 1992-0000167 | Y1 | 1/1992 |
| KR | 10-0563625 | | 3/2006 |
| WO | 98/42420 | A1 | 10/1998 |
| WO | 99/56845 | A1 | 11/1999 |

OTHER PUBLICATIONS

Written Opinion of the International Searching Authority issued in corresponding International Application No. PCT/EP2022/063790, date of mailing Oct. 7, 2022 (6 pages).
Examination Report issued in corresponding German Application No. 10 2021 113 338.6, dated Dec. 29, 2021 (4 pages).
Puzzle Roboter (1 page).
2020 500 Pc. Jigsaw Puzzle, EBay, 2020, retrieved from the Internet on Apr. 3, 2024; Website: https://www.ebay.com/p/27045715135?iid-175861418857, (Year: 2020) (1 page).
English translation of International Preliminary Report on Patentability issued in corresponding PCT/EP2022/063790, dated Nov. 21, 2023 (7 pages).

* cited by examiner

SYSTEM FOR STORAGE OF PUZZLE PIECES, SALES UNIT OF A PUZZLE AND A METHOD FOR MANUFACTURING A PUZZLE

BACKGROUND OF THE INVENTION

Field of the Invention

The invention relates to the field of puzzles, especially a sales unit of a puzzle, which comprises a plurality of puzzle pieces which together forms a picture, as well as a system for storage of a puzzle with a storage container for storing the puzzle pieces, which is also a part of the sales unit. The present invention also concerns a method for manufacturing puzzles.

Most Recent Background Art

Puzzle games are known products, in which a motif, for example a photo, a drawing or a designed graphic image, is manufactured as a puzzle. The motif is very often selected by the manufacturer of the puzzle game in order to then manufacture a plurality of puzzle games with identical motifs. Meanwhile, it is also possible for the customer to use a personal motif and to upload his order, for example, through an Internet page or an app. A template of the motif is very often enclosed in order to make it easy for the customer to reassemble the puzzle. Very often the template of the motif is on the box containing the puzzle. In many cases, the template of the motif is also enclosed as a separate printout, for example as a poster. According to the most recent background art, the puzzle itself is either kept in a bag or the individual puzzle pieces are kept in a box without using a bag. Also, sometimes the puzzle comprises a plurality of bags each of which contains a part of the motif.

Due to the nature of the manufacturing process, in many cases it happens that, one or more puzzle pieces are missing from a puzzle game. The customer concerned often only notices this either very late or at the end of reassembling the puzzle motif. This situation is very annoying for the customer concerned, because then he cannot reassemble the puzzle completely. Sometimes the customer does have the option of making a complaint against the product. But then he might have to again reassemble the puzzle motif completely. In this situation, many manufacturers offer the option of ordering individual pieces. But even this can lead to an additional expense and time delay for the customer concerned.

A further problem arises for a section of customers. A section of customers is either less skilled in assembling puzzle pieces or are less motivated to perform this activity, which demands a lot of time and patience. For example, if the motif contains large single-colored areas, then assembling these motif pieces is usually more difficult than in case of motif or motif pieces which are designed to be very varied. This can be the case especially when using personal motifs because at the time of selecting the motif, many customers hardly pay any attention to the suitability of the motif as a puzzle. Thus, in practice the problem arises that the motif is too difficult for the respective customer.

The American publication U.S. Pat. No. 3,879,861 A describes a board game for character analysis in which recesses are provided in a game board to accommodate insert pieces. The insert pieces show various shapes of head parts and together form a head when they are inserted into the recesses. However, the insert pieces do not only show a specific head when they are inserted, but form different heads through various combinations. Other insertion pieces can relate to other parts of the body. In addition to depicting certain shapes of head or body parts, the inserts also have references to character traits associated with the shapes, so that a player who has placed suitable inserts in the recesses for a certain person receives a characterization of the person. Several insert pieces can be arranged one above the other in the recesses to provide a selection of different shapes, whereby the selected shape of a head or body part is arranged at the top of the stack in the recess so that it is visible.

The German utility model DE 89 00 811 U1 discloses a puzzle box for playing, sorting and storing puzzle games and individual puzzle pieces.

The French publication FR 2 758 529 A1 describes an advent calendar with 24 spherical containers, each containing a puzzle piece.

DISCLOSURE OF THE INVENTION

Object of the Invention

The object of the present invention is to create a puzzle game where the customer can recognize before the assembly whether all puzzle pieces are available and the customer moreover has the option of himself selecting the difficulty level of the puzzle.

Technical Solution

This object is solved by a sales unit of a puzzle with the features from claim 1, a system for storage of a puzzle with the features from claim 9 as well as a method for manufacturing a puzzle with the features from claim 18. The object of the related claims is to create advantageous designs.

According to the invention, the first partial problem is solved by using a sales unit for a puzzle or a system for storage of a puzzle so that the puzzle pieces are not mixed up and jumbled in a storage container like a box or a bag. The pieces are rather stored in a suitable ordered manner so that it can be easily identified if the number of puzzle pieces is complete by looking at it. The puzzle pieces, which form a picture when put together, are thus assembled together, depending on or irrespective of one or more motifs of the picture, in at least two or more groups with two or more puzzle pieces in each, wherein the groups of puzzle pieces are arranged separate from each other in a storage container. During the manufacture of the puzzle, when the puzzle pieces are separated after dividing the picture into individual puzzle pieces, the separated puzzle pieces of one picture are assembled together depending on or irrespective of one or more motifs of the picture into two or more groups of puzzle pieces and are separated from each other in groups. In order to avoid mixing up the puzzle pieces in a storage container, but rather storing them in a suitable ordered manner, the sales unit has two or more sub-storage containers arranged inside the storage container, wherein one group of puzzle pieces is received in each of the sub-storage containers.

Each sub-storage container is designed in such a manner that through the design of the sub-storage containers and the puzzle pieces, the completeness of the puzzle pieces of each group of puzzle pieces can be ascertained through the interaction of the puzzle pieces and of the sub-storage containers. Thus, the sub-storage container provides a measure for the number of received puzzle pieces or for the completeness of the group of puzzle pieces received in the sub-storage container, wherein this can be done in the simplest manner by matching one dimension of the sub-storage container to one dimension of the puzzle pieces, e.g., their thickness or the number of puzzle pieces. Alternatively or additionally, the sub-storage container can have a visible marking which can help to ascertain whether the number of the received puzzle pieces is as specified.

According to the invention, the second partial problem is solved in that each group of puzzle pieces can be assembled into a puzzle by itself and that each group preferably produces a connected part of the entire picture or the puzzle motif and all the groups together produce the complete puzzle. Thus, the user can himself decide if he wants to assemble the individual groups into a puzzle or mix together two or more groups and assemble them together into a puzzle. Thus, the user has a lot of flexibility in deciding which parts of a picture he wants to assemble into a puzzle at which difficulty level.

A picture in the present description is any type of representation of any type of carrier, like cardboard, which can be separated into individual puzzle pieces, so that a puzzle with a plurality of puzzle pieces is created which can be in turn assembled into the picture.

The number of puzzle pieces in each group can be identical, so that it can be quickly ascertained whether one or more puzzle pieces are missing in a group.

Each group can contain any number of puzzle pieces and can depend on the number of all the puzzle pieces of the puzzle, so that puzzles with a large number of puzzle pieces can have groups with puzzle pieces, whereas puzzles with lesser number of total puzzle pieces can have groups with a lesser number of puzzle pieces. The number of puzzle pieces in each group can be less than or equal to 250 puzzle pieces, especially less than or equal to 100 puzzle pieces, preferably less than or equal to 50 puzzle pieces or less than or equal to 25 or 10 puzzle pieces.

The puzzle pieces in each group of puzzle pieces can represent a clearly defined partial segment of the complete puzzle, wherein the partial segment can be defined by at least one characteristic of the puzzle pieces of a group, which is selected from a number of characteristics comprising the relation to one or more rows of the puzzle, the relation to a part of one or more rows of the puzzle, the relation to one or more columns of the puzzle, the relation to a part of one or more columns of the puzzle, the relation to a local area of the puzzle, one or more basic colors or color elements of the puzzle pieces, boundary pieces of the puzzle, number of recesses or protrusions of the puzzle pieces and combinations thereof.

The puzzle pieces in a group can be sorted, especially according to one of the previously described characteristics of the puzzle pieces, and/or stacked in the sales unit or arranged in the system for storage of the puzzle. This would make it easy to ascertain the correct number of puzzle pieces. For example, if the stacks contain the same number of puzzle pieces, then their height is identical and it can be very easily identified if a puzzle piece is missing because the concerned stack will be shorter. In the same way, other reference sizes can be considered, for example like the holding capacity of a sub-storage container or the height of the sub-storage container or heights of its surrounding walls or markings on the sub-storage container.

Accordingly, protection is requested for an aspect of the invention, independent and irrespective of other aspects of the invention, according to which aspect a claim is made for a system for storage of a puzzle which comprises a plurality of puzzle pieces, which together produce a picture, wherein the system comprises a storage container for storage of the puzzle pieces and two or more sub-storage containers, wherein each sub-storage container can receive a group of puzzle pieces with two or more puzzle pieces. Additionally, each sub-storage container has a measure using which the completeness of the puzzle pieces of each group of puzzle pieces in the sub-storage container can be ascertained when they are arranged in the sub-storage container.

For this purpose, the sub-storage container can be designed to be dimensionally stable in at least one dimension in such a manner that the dimensionally stable dimension of the sub-storage container represents a measure, by, for example, being able to store an exact number of puzzle pieces in the sub-storage container. Additionally or alternatively, the sub-storage container can have a marking which functions as a measure.

The sub-storage containers can be separate individual containers and/or shelves or sections of a common container for multiple groups.

The sub-storage containers can preferably be designed in such a manner that exactly one stack of puzzle pieces can be received in each sub-storage container, so that the correct number of received puzzle pieces can be ascertained easily.

This can be especially achieved in that one or each sub-storage container is designed in such a manner that it defines a storage space which is exactly dimensioned in one dimension in such a manner that a stack of a certain number of puzzle pieces can be kept in the storage space or the stack closes flush with the upper edge of the storage space. Alternatively or additionally, a corresponding marking on the sub-storage container can be used to check that the sub-storage container has been filled with the correct number of puzzle pieces.

The sub-storage container can be especially designed as a closable tube or tub or rectangular container and preferably have a circular or rectangular cross-section whose diameter or dimension are selected so that the puzzle piece with the largest dimension from among the puzzle pieces to be stored can be stored with some gap so that all the puzzle pieces are received loosely. Moreover however, the diameter or dimension can be sufficiently small so that a stack can be stored in dimensionally-stable manner in the sub-storage container, that is, individual puzzle pieces cannot break loose from the stack.

The sub-storage containers can be formed as cuboid containers made of cardboard or carton, which can be formed by suitable folding.

The sub-storage containers can include opening or removal aids to facilitate removal of the puzzle pieces. In particular, for example, sub-storage containers made of cardboard or paperboard can be provided with perforations and/or bending or kinked edges that allow at least partial tearing of the sub-storage containers and folding over of at least partial areas of the walls of the sub-storage container.

The storage container can be made especially using a two-piece cube-shaped carton preferably with a cover and lower part or bottom part, respectively, wherein the sub-storage containers can be made preferably using a one-piece insert for the storage container with a plurality of pockets for storing groups of puzzle pieces. Alternatively, an insert element can be provided which has slots in which the individual sub-storage containers can be especially inserted flexibly. The insert and/or the insert element can be imprinted, especially with the representation or the motif of the picture, wherein the representation or the motif of the picture can be used to arrange the groups of puzzle pieces or sub-storage containers in the pockets or slots where they are received, that is, the puzzle pieces received in a certain pocket or slot of the insert or insert element produce the corresponding part of the picture that is imprinted there.

The sub-storage containers can be respectively closed individually or together. For this purpose, an intermediate layer element can be provided which can be arranged between the storage container, especially between its cover, and the sub-storage containers in order to securely hold and/or close the sub-storage containers. The intermediate layer element can be flexible, for example, an upholstered cushion made of cardboard, plastic, foam or similar material.

Furthermore, a closure foil can be provided on the storage container, in particular a bottom part thereof, which closes the storage container or a part thereof, such as the bottom part thereof, together with the sub-storage containers accommodated therein. For this purpose, the sealing foil for closing an opening of the storage container or a part thereof can be arranged on the opening edge in a material-locking manner, in particular glued or welded.

After the puzzle pieces have been separated, the separated groups of puzzle pieces can be stored in the individual sub-storage containers in the manufacturing process, so that the groups of puzzle pieces can be stored separately, wherein the puzzle pieces of each group of separated puzzle pieces in turn represent a clearly defined partial segment of the complete puzzle irrespective of the motif or motifs, wherein especially the partial segment is defined by at least one characteristic of the puzzle pieces of a group, which is selected from a number of characteristics comprising the relation to one or more rows of the puzzle, the relation to a part of one or more rows of the puzzle, the relation to one or more columns of the puzzle, the relation to a part of one or more columns of the puzzle, one or more basic colors or color elements of the puzzle pieces, boundary pieces of the puzzle, number of recesses or protrusions of the puzzle pieces and combinations thereof.

BRIEF DESCRIPTION OF THE FIGURES

The attached drawings show in purely schematic manner in

EXEMPLARY EMBODIMENTS

Further advantages, features and characteristics of the present invention will be evident from the following detailed description of the exemplary embodiments. However, the invention is not limited to these exemplary embodiments.

Figure 1:
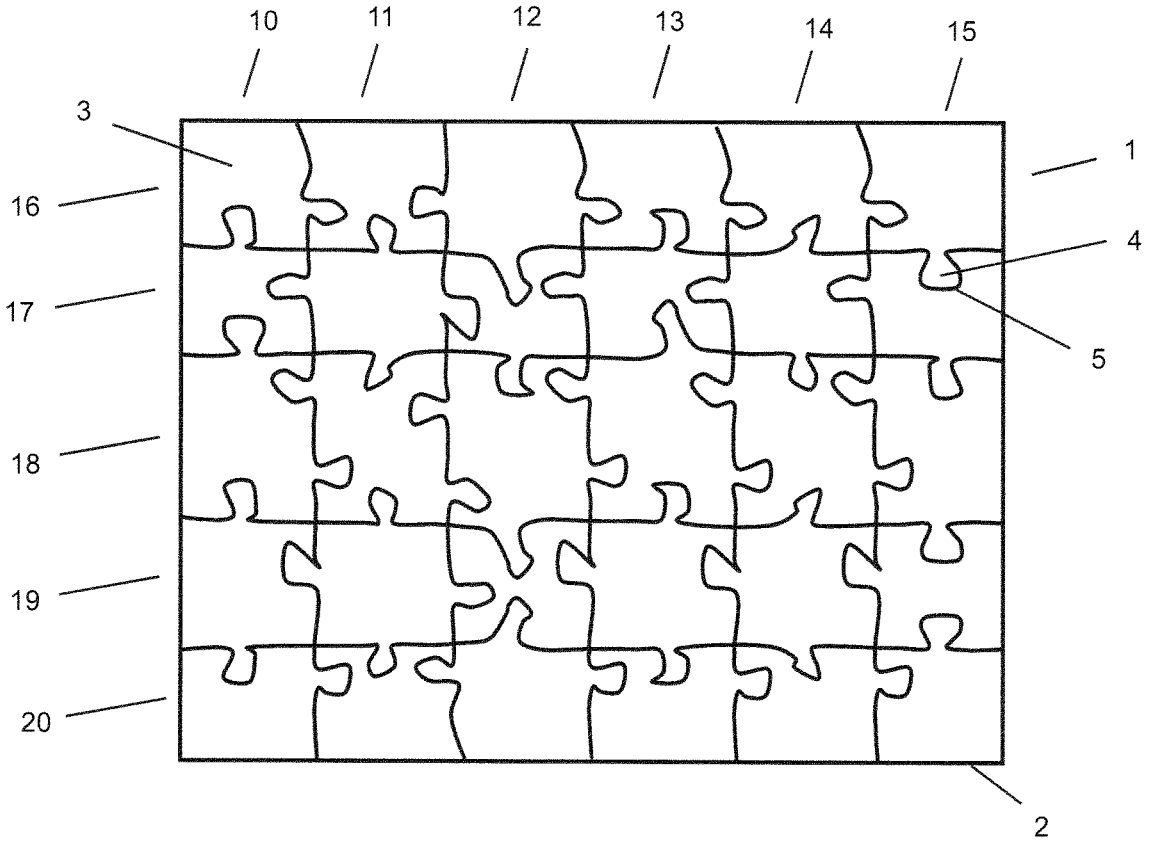
FIG. 1 a representation of a puzzle according to the most recent background art, FIG. 2 a representation of a system for storage of puzzles according to the invention, FIG. 3 a representation of a stack of puzzle pieces which are stored in a sub-storage container according to the invention, FIG. 4 a top view of a separate sub-storage container containing a stack of puzzle pieces, FIG. 5 a perspective view of the sub-storage container from FIG. 4, FIG. 6 a perspective view of another sub-storage container with a cap, FIG. 7 a perspective exploded view of a storage container with an intermediate layer element and an insert element with a plurality of separate sub-storage containers, FIG. 8 a sectional view through the bottom part of the storage container from FIG. 7 with a sub-storage container wedged into the insert part, FIG. 9 a sectional view through the bottom part of the storage container of FIG. 7 with a sub-storage container clamped in the insertion part, which is closed by a sealing foil on the bottom part, FIG. 10 a perspective view of a further sub-storage container and in FIG. 11 a side view of the sub-storage container from FIG. 10.

FIG. 1 shows a standard puzzle 1, which represents a picture 2 in the assembled state, which is represented using a carrier, for example, a cardboard carton, and a representation of a motif printed on it. The picture 2, as is standard for puzzle 1, can be separated into a plurality of individual pieces, the so-called puzzle pieces 3, wherein a sales unit of puzzle 1 comprises of the separated puzzle pieces 3 usually in a storage container and the user assembles the puzzles pieces 3 into the picture 2.

The puzzle pieces 3 have these protrusions 4 and recesses 5 for assembling them, which can be designed in various ways, wherein at least one protrusion 4 matches a recess 5, so that the corresponding puzzle pieces 3 can be assembled. The protrusions 4 and recesses 5 of a plurality of puzzle pieces 3 can be designed differently from all or at least a large part of these puzzle pieces, so that a unique arrangement of the puzzle pieces 3 to one another can be produced at least in conjunction with the edges of the puzzle pieces 3 to one another which can similarly vary between the various puzzle pieces.

Often, the puzzle pieces 3 are arranged in 16 to 20 rows and 10 to 15 columns, so that the unique position of each of the puzzle pieces 3 can be defined by specifying the corresponding row 16 to 20 and the column 10 to 15. For example, the puzzle piece 3 located in the upper left corner of puzzle 1 in FIG. 1 can be defined by row 16 and column 10, so that the specification of the row and column, e.g. (16; 10), uniquely defines the position of the puzzle piece 3. However, there are also puzzles whose puzzle pieces 3 can be designed and arranged in a completely random manner. Such puzzles are known as so-called random—cut—puzzles.

In case of puzzles constructed in rows and columns as well as random—cut—puzzles, clearly defined partial segments of the puzzle 1 can be specified depending on or irrespective of a motif. According to the present invention, these partial segments can be assembled into groups in the manufacturing process and the groups can be separated. For example, in the exemplary embodiment shown in FIG. 1, the puzzle pieces 3 from the individual rows 16 to 20 or in the individual columns 10 to 15 can be defined into one group respectively. Or groups can be formed from a certain number of puzzle pieces 3, for example, groups of 6 puzzle pieces respectively, like for example the puzzle pieces 3 of the rows 16, 17 and 18 as well as of the columns 10 and 11, the puzzle pieces 3 of the rows 19 and 20 and of the columns 10, 11 and 12, the puzzle pieces 3 of the rows 16, 17 and 18 and of the columns 12 and 13 as well as the puzzle pieces 3 of the rows 16, 17 and 18 as well as of the columns 14 and 15 and the puzzle pieces 3 of the rows 19 and 20 and of the columns 13, 14 and 15. Thus, irrespective of the motif of the picture 2, groups of puzzle pieces 3 can be formed which can be assembled individually from one another and separated if, in the manufacturing process of the puzzle, they have been detached and separated from one another after the picture 2 has been cut into the individual puzzle pieces 3.

Figure 2:
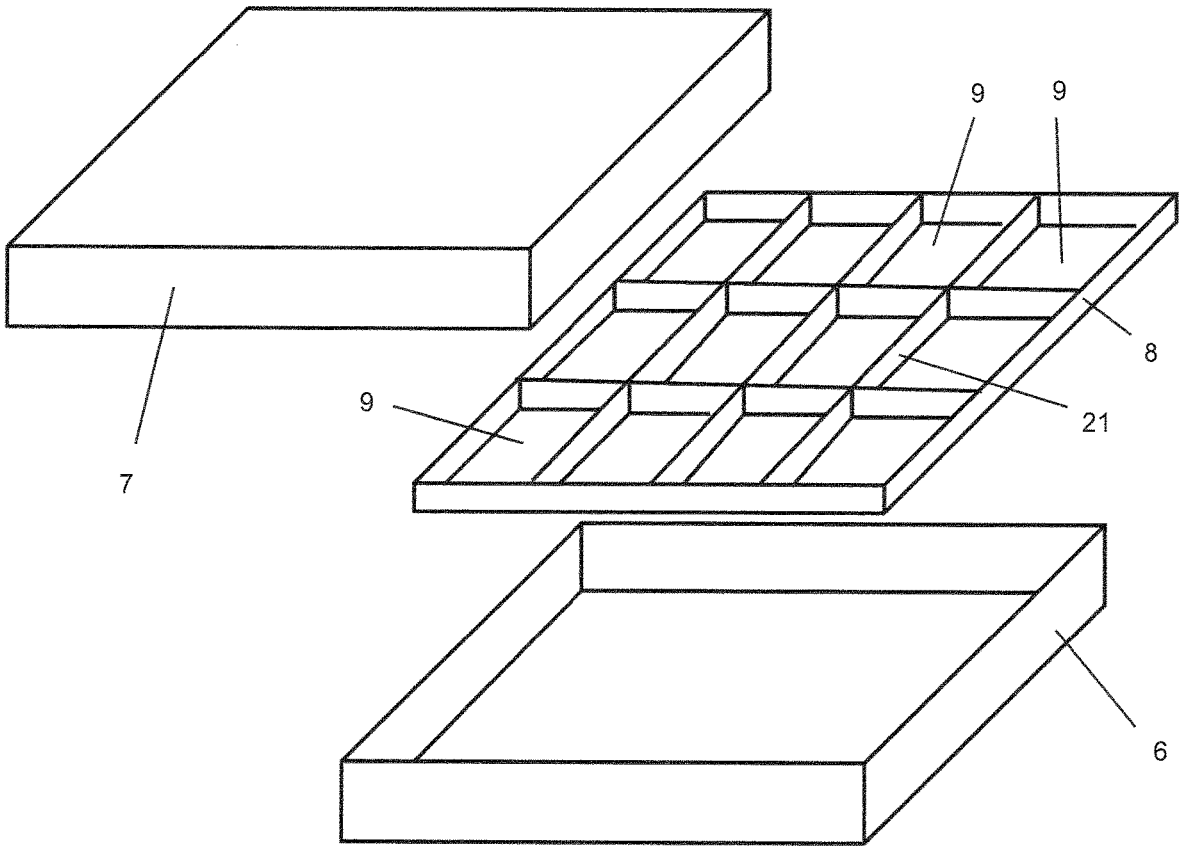

The respective groups of puzzle pieces 3 can be stored in the corresponding sub-storage containers 9, as shown as an example in FIG. 2, so that the corresponding groups of puzzle pieces 3 are received in different sub-storage containers in a sales unit of a puzzle 1 and a user can assemble parts of the puzzle according to the groups of puzzle pieces 3. Naturally, a user can disassemble a completed puzzle 1 again into groups of puzzle pieces 3 depending on how he wants to separate them, wherein the individual groups can be stored in the sub-storage containers 9 separately from one another.

FIG. 2 shows an example for a system for storage of puzzle pieces 3 separated according to groups of puzzle pieces 3, as described above. FIG. 2 shows a storage container with a bottom part 6 and a cover part 7, which together form a cube-shaped carton in which the puzzle pieces 3 can be stored. For separate storage of individual groups of puzzle pieces 3, an insert 8 is provided in the storage container 6, 7 or in the bottom part 6. Similar to the bottom part 6, the insert is formed by an open-top, cube-shaped box or tub, which however has multiple separating walls 21 parallel to the outer sides, so that this form multiple sub-storage containers 9 with an open top in which the individual groups of puzzle pieces 3 can be kept. For example, if the number of puzzle pieces 3 in each group is the same and/or have the same size, which can be easily seen, then this makes it easy to check whether the puzzle pieces 3 of the puzzle 1 received in the storage container 6, 7 or in the sub-storage containers 9 are complete.

Figure 3:
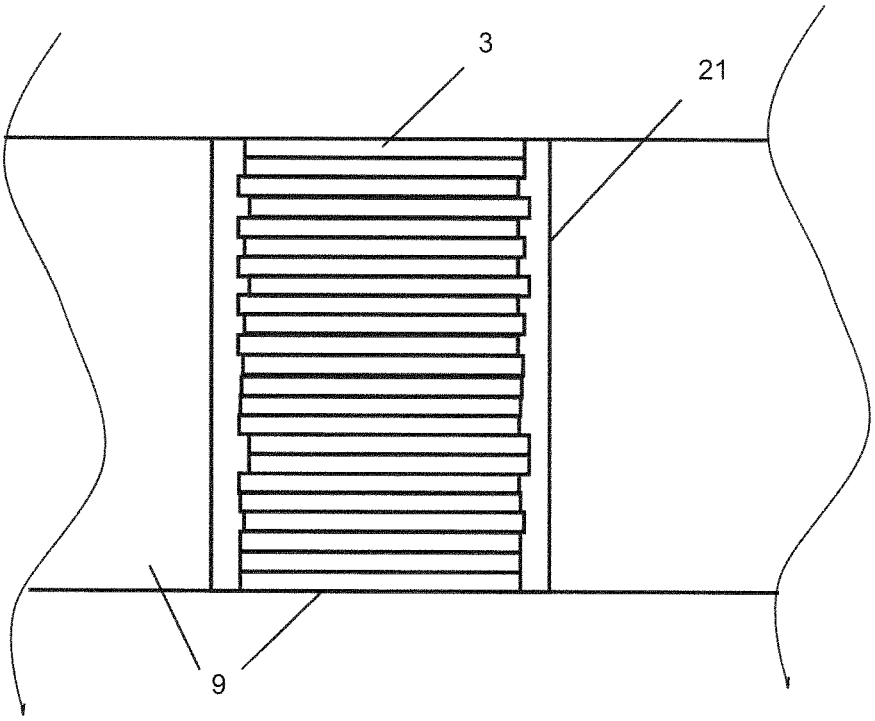

This can be easy especially in case of a larger number of puzzle pieces 3 per group, if the puzzle pieces 3 can be stacked in a sub-storage container 9, so that a single or multiple stacks of puzzle pieces 3 can be received in the sub-storage container 9. This is shown for example in FIG. 3 for a stack of puzzle pieces 3, wherein FIG. 3 shows a detailed view of one of the several sub-storage containers arranged adjacent to one another and several puzzle pieces 3 are stacked in one of the sub-storage containers 9. However, the stack of puzzle pieces in the shown exemplary embodiment are not arranged standing on the lowest puzzle piece but horizontally, so that the stack of puzzle pieces 3 in the storage state is horizontal to the bottom of the sub-storage container 9. As shown in FIG. 3, the stack of puzzle pieces 3 has a height equal to the length of the sub-storage container 9 or a bordering separating wall 21, so that the upper- and lower side of the stack lies flat on the separating walls 21 running parallel to the upper- or lower side of the stack and the stack is wedged in between the separating walls 21. If the sub-storage container 9 contains the correct number of puzzle pieces 3, then the stack is wedged in tightly in the sub-storage container 9, whereas the stack cannot be held in the sub-storage container 9 if puzzle pieces 3 are missing.

Figure 4:
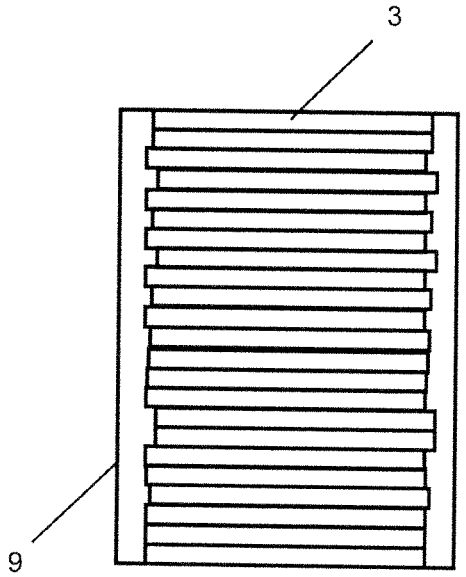
Figure 5:
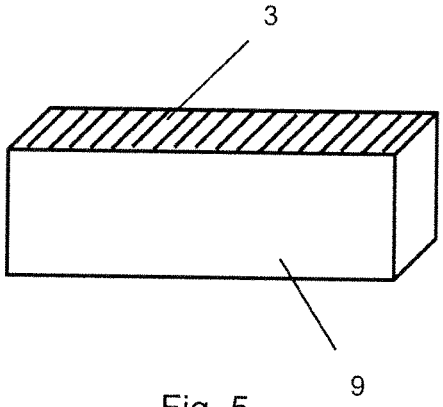

FIG. 3 shows this for one of the multiple sub-storage containers 9 of the insert 8. The FIGS. 4 and 5 show the same storage principle for a sub-storage container 9, which is designed separately. Multiple open-top, cube-shaped sub-storage containers 9, as shown in top view with puzzle pieces 3 wedged therein in FIG. 4 and in perspective view in FIG. 5, can be arranged in a storage container for the puzzle, for example in a cube-shaped box.

Figure 6:
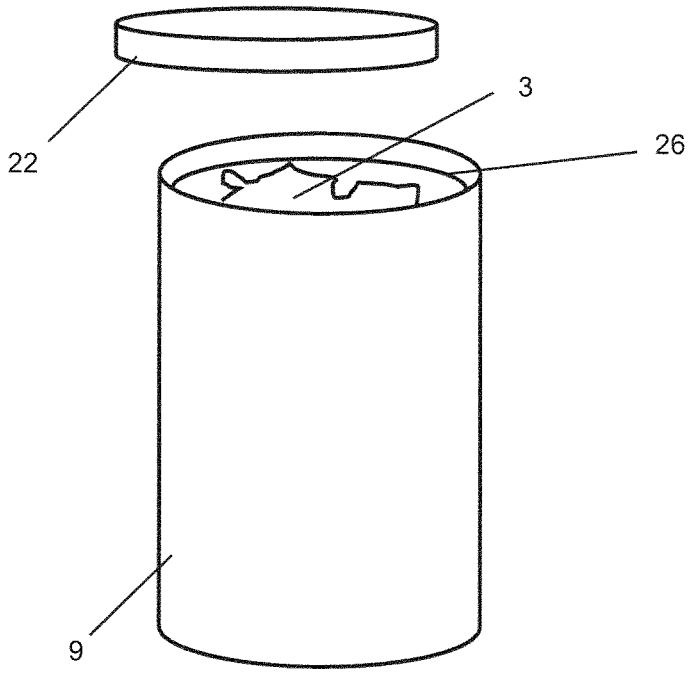

Another embodiment of a sub-storage container 9 is shown in FIG. 6. The sub-storage container 9 of the FIG. 6 is formed by a tub or a one-sided or double-sided closable tube with a circular cross-section, wherein the diameter of the circular cross-section is somewhat larger than the largest dimension of the puzzle pieces 3 to be stored in it, so that a stack of puzzle pieces 3 can be received in the sub-storage container, wherein in this case the puzzle pieces 3 will be received loosely. However, the maximum diameter of the circular cross-section of the tub—or tube-shaped sub-storage container is dimensioned so that individual puzzle pieces 3 of the stack cannot slip out of the stack and, for example, fall in a gap between the stack and the sub-storage container 9.

Moreover, the embodiment of a sub-storage container 9 from the FIG. 6 shows that a corresponding sub-storage container 9 can have a cap 22 in order to prevent the puzzle pieces 3 from falling out.

Furthermore, a marking 26 is provided in FIG. 6 on the upper edge of the sub-storage container 9, using which the correct number of puzzle pieces 3 in the sub-storage container 9 can be easily ascertained. Thus, in this case, the stack of puzzle pieces 3 need not close flush with the upper side of the sub-storage container 9, rather the upper side of the stack must match the marking 26 of the sub-storage container.

However, it is also possible to consider the height of the sub-storage container 9 as a measure for the number and completeness of the puzzle pieces 3 instead of the marking 26. In this case, the puzzle pieces 3 or the upper side of the stack closes flush with the upper boundary of the tub- or tube-shaped sub-storage container 9, if the correct number of puzzle pieces 3 are to be contained in the sub-storage container 9. If the sub-storage container 9 closes its upper side of the edge flush with the puzzle pieces 3, then it contains the correct number of puzzle pieces 3, while this is not the case if a puzzle piece 3 is missing and the shortage of the puzzle piece/s 3 can be easily and quickly identified.

Figure 7:
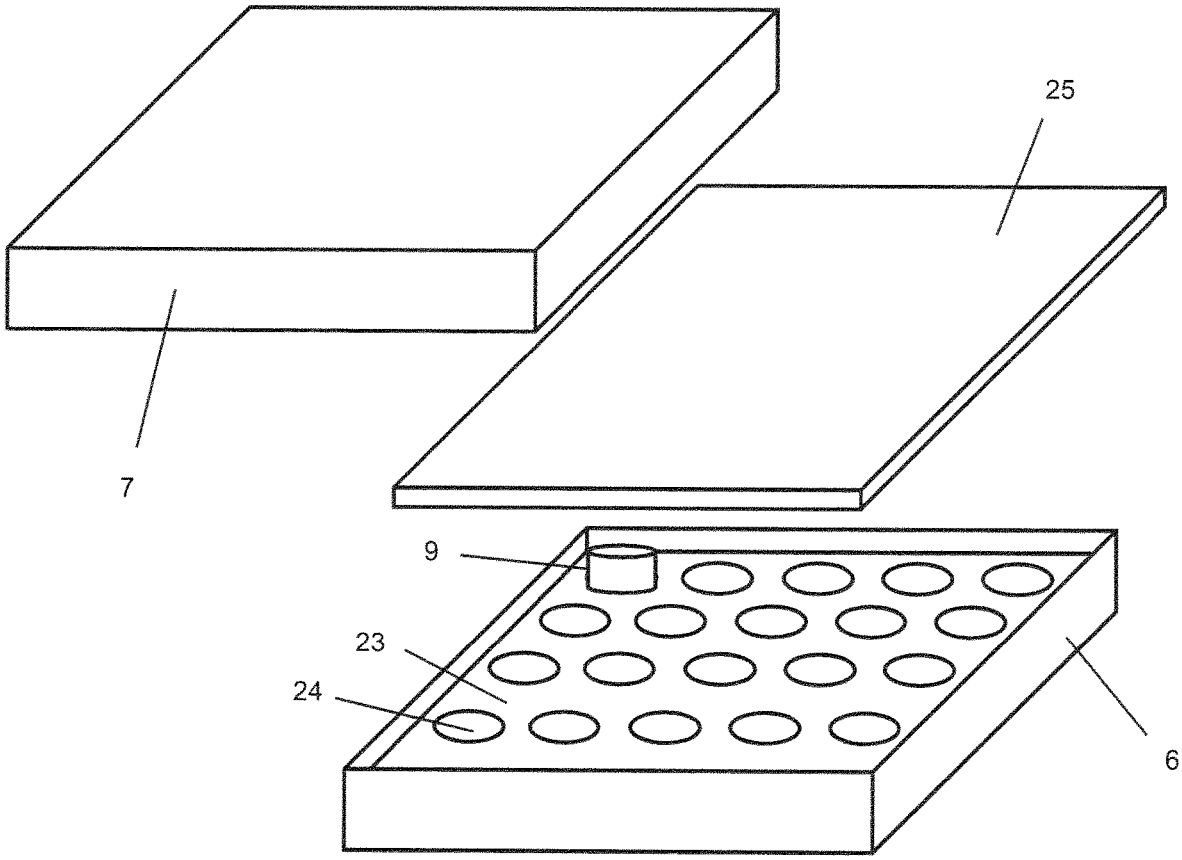

The individual sub-storage containers 9 can be received according to the exemplary embodiments of FIG. 7 into a cube-shaped storage container 6, 7 in the form of a 2-piece box. As shown in FIG. 7, an insert element 23 with a plurality of pockets 24 is arranged in the bottom part 6, wherein the sub-storage containers 9 can be inserted in the pockets 24. Here, the diameter of the pockets 24 can be somewhat smaller than the outer diameter of the sub-storage containers 9, so that a sub-storage container 9 fits tightly in the pocket 24 of the insert element 23.

The sub-storage containers 9 can be unclosed on the top, since an intermediate layer element 25 is inserted between the sub-storage containers 9 and the cover part 7, so that this closes the upper sides of the sub-storage containers 9. Preferably the intermediate layer element 25 can be elastically deformable, so that it can be pressed against the sub-storage containers 9 with the cover part 7, so that the sub-storage containers 9 are closed securely.

In this exemplary embodiment, the user can at will remove and separately empty the individual sub-storage containers 9 after opening the storage container 6, 7 by removing the cover part 7 and removing the intermediate layer element 25. However, the user can at least partly leave the sub-storage containers 9 in the insert element 23 and jointly empty the sub-storage containers 9 kept in the insert element 23 by simply turning over the bottom part 6. Accordingly, the user can himself ascertain the difficulty level of the puzzle 1 by either only assembling individual or multiple partial segments of the puzzle 1 according to the groups in the sub-storage containers 9 or assembling the entire puzzle 1 with all partial segments by tipping together all the puzzle pieces from the sub-storage containers 9. Moreover, the user can identify if the respective sub-storage containers 9 contain the correct number of puzzle pieces 3 at a glance, since the puzzle pieces 3 stacked in the sub-storage container 9 must be arranged flush either with a marking or with a specified limit of the sub-storage container 9.

Figure 8:
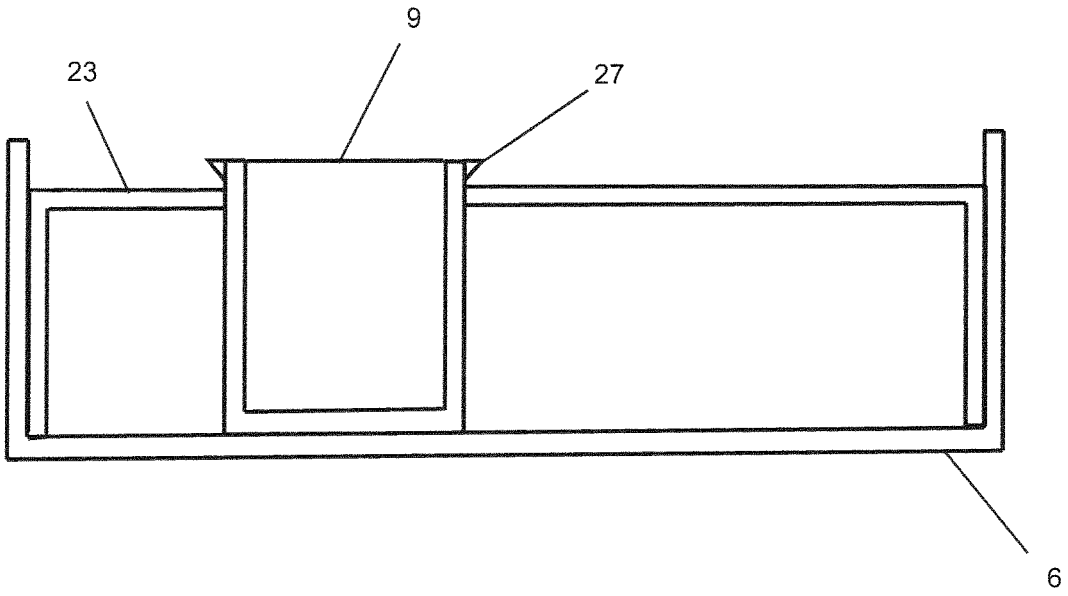

FIG. 8 shows a sectional view through the bottom part 6 of the storage container 6, 7 of the FIG. 7. FIG. 8 shows a sub-storage container 9 which is wedged in the insert element 23. The sub-storage container 9 has a strengthened edge 27 in order to make it easier for the user to easily grip the sub-storage container 9 and remove it from the insert element 23.

Figure 9:
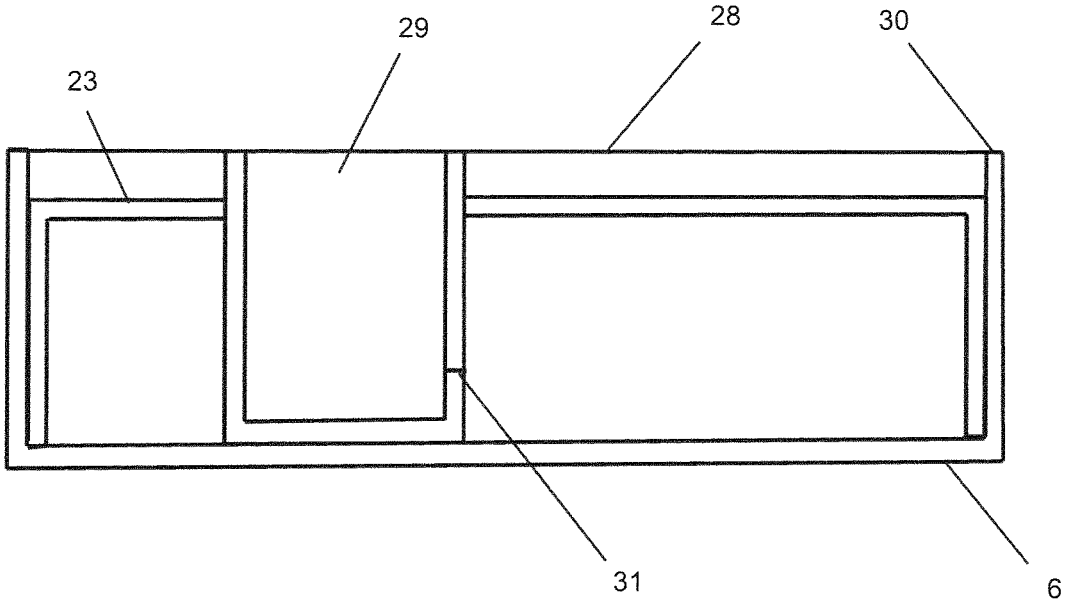

FIG. 9 shows a further sectional view through the bottom part 6 of the storage container 6, 7 of FIG. 7. FIG. 9 shows a sub-storage container 29 which is clamped in the insertion element 23. The sub-storage container 29 is designed so that its open upper side, when it is inserted in the bottom part 6 of the storage container 6, 7 and the insertion element 23, is aligned with the upper container edge 30 of the bottom part 6. A sealing foil 28 is attached to the edge 30 of the container, for example by gluing or welding, to close the sub-storage container 29 and the bottom part 6.

Figure 10:
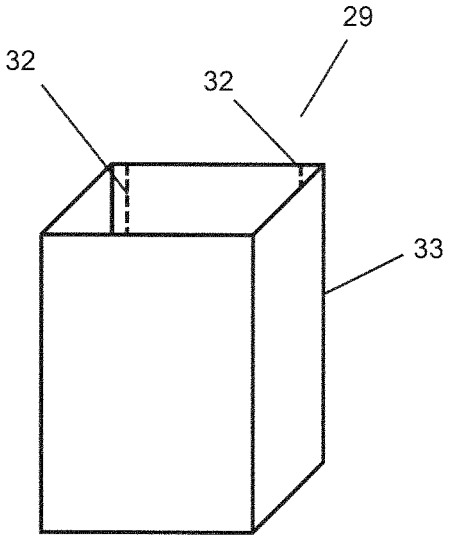
Figure 11:
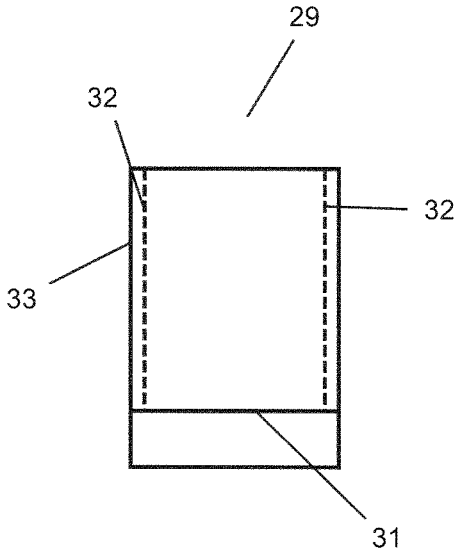

The sub-storage container 29 is a cuboid container made of cardboard or carton, which has opening or removal aids in the form of perforations 32 and bending edges 31, as can be seen in particular in FIGS. 10 and 11. FIG. 10 shows a perspective view of the rectangular sub-storage container 29, while FIG. 11 shows a side view of the same sub-storage container 29. As can be seen in particular from FIG. 11, two perforations 32 running parallel to the edge 33 of the sub-storage container 29 are formed on a side wall, which enable the side wall to be torn open along the perforations 32. In the lower area of the side wall, a bending or kinked edge 31 is formed at the end of the perforations 32, which enables the side wall to be bent along the bending edge 31. A user can thus remove the sub-storage container 29 from the storage container 6, 7, tear open the side wall along the perforations 32 and fold it over along the bending edge 31 in such a way that there is easy and simple access to the puzzle pieces 3 arranged in the sub-storage container 29. In the embodiment example shown in FIG. 11, the perforations 32 within the side wall are shown slightly offset from the edges 33 of the sub-storage container 29, but the perforations can also be formed directly on the edge 33.

Although the present invention is described in detail using the exemplary embodiments, it is evident to the expert that the invention is not limited to these exemplary embodiments. Rather variations are possible in that individual characteristics are left out or other combinations of characteristics can be achieved without leaving the scope of protection of the enclosed claims. The present disclosure especially includes all combinations of the individual characteristics shown in the various exemplary embodiments, so that individual characteristics described only in relation to one exemplary embodiment can also be used in other exemplary embodiments or in combinations of individual characteristics not shown explicitly.

LIST OF REFERENCES

1 Puzzle
2 Picture
3 Puzzle piece
4 Protrusion
5 Recess
6 Bottom part
7 Cover part
8 Insert
9 Sub-storage container
10, 11, 12, 13, 14, 15 Columns
16, 17, 18, 19, 20 Rows
21 Separating wall
22 Cap
23 Insert element
24 Pocket
25 Intermediate layer element
26 Marking
27 Strengthened edge
28 Closure foil
29 Sub-storage container
30 Container rim
31 Kinked edge
32 Perforation

The invention claimed is:

1. Sales unit comprising a puzzle comprising a plurality of puzzle pieces which together form a picture, as well as a storage container for the puzzle pieces, wherein the puzzle pieces of the picture are assembled into two or more groups with two or more of the puzzle pieces respectively, wherein each of the groups of puzzle pieces are arranged in the storage container separately from one another, and two or more sub-storage containers which are arranged in the storage container, wherein each of the sub-storage containers receives one of the groups of the puzzle pieces, wherein each of the sub-storage containers is designed in such a manner that through a design of the sub-storage containers and the puzzle pieces completeness of the puzzle pieces of each of the group of puzzle pieces can be ascertained through comparison of the puzzle pieces with the sub-storage containers before assembly of the puzzle pieces for forming the picture.

2. The sales unit according to claim 1, wherein the dimensions of the puzzle pieces of a group and the dimensions of a related sub-storage container are matched to one another in such a manner that exactly a certain number of the puzzle pieces, corresponding to a number of puzzle pieces of the group of puzzle pieces, fits into the related one of the sub-storage containers, and/or that a related one of the sub-storage containers has a visible marking which shows the number or completeness of the puzzle pieces in the related one of the sub-storage containers when the related one of the sub-storage containers is filled with the puzzle pieces till visible marking.

3. The sales unit according to claim 1, wherein the number of puzzle pieces is identical in each of the groups of puzzle pieces.

4. The sales unit according to claim 1, wherein the number of puzzle pieces per groups of puzzle pieces is lesser than or equal to 250 puzzle pieces.

5. The sales unit according to claim 1, wherein the puzzle pieces of each of the groups of puzzle pieces represent a clearly defined partial segment of a complete puzzle.

6. The sales unit according to claim 5, wherein the partial segment is defined by at least one characteristic of the puzzle pieces selected from a number of characteristics comprising the relation to one or more rows of the puzzle, the relation to a part of one or more rows of the puzzle, the relation to one or more columns of the puzzle, the relation to a part of one or more columns of the puzzle, the relation to any local area of the puzzle, one or more basic colors or color elements of the puzzle pieces, boundary pieces of the puzzle, number of recesses or protrusions of the puzzle pieces and combinations thereof.

7. The sales unit according to claim 1, wherein the puzzle pieces are sorted into one of the groups of puzzle pieces and/or are stacked.

8. The sales unit according to claim 7, wherein each of the sub-storage containers are designed in such a manner that each of the sub-storage containers define a storage space which has the exact dimensions so that a stack of a certain number of the puzzle pieces are wedged in the storage space or closes flush with an upper edge of the storage space and/or that the storage space has a marking which functions as a measure for the number of the puzzle pieces received in one of the sub-storage containers.

9. A system for storage of a puzzle comprising a plurality of puzzle pieces, which together form a picture, and a storage container for storage of the puzzle pieces, wherein the system comprises two or more sub-storage containers, wherein each of the sub-storage containers can receive a group of puzzle pieces of the picture with two or more puzzle pieces, wherein each of the sub-storage containers has a measure so that completeness of the puzzle pieces of each of the groups of puzzle pieces in each of the sub-storage containers can be ascertained by using the measure when the puzzle pieces are arranged in each of the sub-storage containers before assembly of the puzzle pieces for forming the picture.

10. The system according to claim 9, wherein each of the sub-storage containers is designed to be dimensionally stable in at least one dimension in such a manner that the dimensionally stable dimension of each of the sub-storage containers forms the measure, and/or each of the sub-storage containers has a marking which functions as the measure.

11. The system according to claim 9, wherein each of the sub-storage containers are separate individual containers and/or trays or sections of a common container for several groups.

12. The system according to claim 9, wherein each of the sub-storage containers are designed in such a manner that exactly one stack of puzzle pieces can be received in each of the sub-storage containers and/or that each of the sub-storage containers comprises opening or removal aids.

13. The system according to claim 9, wherein each of the sub-storage containers is designed as closable tubes or tubs or cuboidal containers and has a circular or rectangular cross-section whose diameter or dimension are selected in such a manner that one of the puzzle pieces with the largest dimension, among the puzzle pieces to be received, can be received with some gap.

14. The system according to claim 9, wherein the storage container is formed by a two-piece, cube-shaped carton with a cover and a lower part.

15. The system according to claim 9, wherein each of the sub-storage containers are formed by a one-piece insert for the storage container with a plurality of pockets for storing the groups of the puzzle pieces or that the storage container has an insert element with a plurality of pockets for keeping the sub-storage containers.

16. The system according to claim 15, wherein the insert and/or the insert element are imprinted with the representation or the motif of the puzzle.

17. The system according to claim 9, wherein the system furthermore comprises of an intermediate layer element which is arranged between the storage container and the sub-storage containers in order to securely hold and/or to close the sub-storage containers, wherein the intermediate layer element is elastically deformable or the storage container comprises a closure foil which is firmly connected to the storage container in order to securely hold and/or close the sub-storage containers.

18. A method for manufacturing a puzzle for a sales unit according to claim 1, wherein the picture is separated into the plurality of puzzle pieces and the separated puzzle pieces of the picture are assembled in the two or more groups of puzzle pieces and are separated from one another in the groups, wherein each of the separated groups of puzzle pieces are stored in one of the sub-storage containers.

19. The method according to claim 18, wherein the puzzle pieces of each of the groups of separated puzzle pieces represents a clearly defined partial segment of the puzzle, wherein each partial segment is defined by at least one characteristic of the puzzle pieces of a group selected from a number of characteristics comprising the relation to one or more rows of the puzzle, the relation to a part of one or more rows of the puzzle, the relation to one or more columns of the puzzle, the relation to a part of one or more columns of the puzzle, the relation to any local area of the puzzle, one or more basic colors or color elements of the puzzle pieces, boundary pieces of the puzzle, number of recesses or protrusions of the puzzle pieces, and combinations thereof.

* * * * *